US006011826A

United States Patent [19]

Conrads et al.

[11] Patent Number: 6,011,826

[45] Date of Patent: Jan. 4, 2000

[54] STEAM POWER STATION

[75] Inventors: Hermann-Josef Conrads, Herzogenaurach; Erwin Laurer, Möhrendorf; Jürgen Model; Rainer Schilling, both of Erlangen; Michael Seiter, Schwaig, all of Germany

[73] Assignee: Siemens Aktiengesellschaft, Munich, Germany

[21] Appl. No.: 09/119,309

[22] Filed: Jul. 20, 1998

Related U.S. Application Data

[63] Continuation of application No. PCT/DE97/00028, Jan. 9, 1997.

[30] Foreign Application Priority Data

Jan. 19, 1996 [DE] Germany ..... 196 01 886

[51] Int. Cl.[7] ..... G21C 13/00; F22B 37/44

[52] U.S. Cl. ..... 376/277; 376/286; 137/360

[58] Field of Search ..... 376/277, 285, 376/286, 292, 293; 137/357, 360; 165/81, DIG. 92, DIG. 126; 122/511, DIG. 15; 248/49, 56

[56] References Cited

U.S. PATENT DOCUMENTS

| | | | |
|---|---|---|---|
| 4,066,498 | 1/1978 | Hoffmann et al. | 376/281 |
| 4,092,490 | 5/1978 | Schabert et al. | 376/293 |
| 4,238,291 | 12/1980 | Neuenfeldt et al. | 376/285 |
| 4,245,412 | 1/1981 | Schabert et al. | 376/286 |
| 4,280,871 | 7/1981 | Hoffmann | 376/277 |

FOREIGN PATENT DOCUMENTS

| | | |
|---|---|---|
| 2259420 | 8/1975 | France . |
| 2317736 | 2/1977 | France . |
| 27 08 642 | 8/1978 | Germany . |
| 27 40 761 | 11/1986 | Germany . |

*Primary Examiner*—Daniel D. Wasil
*Attorney, Agent, or Firm*—Herbert L. Lerner; Laurence A. Greenberg

[57] ABSTRACT

A steam power station, in particular a nuclear power station, includes a steam conduit leading through a wall and forming a fixed point with the wall for the introduction of forces and moments. A main valve is connected to the steam conduit at the fixed point, without a high-pressure pipe being interposed. Satellite valves, which have smaller nominal widths than the main valve, are fastened to the housing of the main valve, without a high-pressure pipe being interposed. At least one additional valve has a housing fastened to the housing of a satellite valve, without a high-pressure pipe being interposed and without any support.

5 Claims, 2 Drawing Sheets

STEAM POWER STATION

CROSS-REFERENCE TO RELATED APPLICATION

This application is a continuation of copending International Application No. PCT/DE97/00028, filed Jan. 9, 1997, which designated the United States.

BACKGROUND OF THE INVENTION

Field of the Invention

The invention relates to a steam power station, in particular a nuclear power station, including a steam conduit leading through a wall and forming a fixed point with the wall for the introduction of forces and moments, a main valve connected to the steam conduit at the fixed point, without a high-pressure pipe being interposed, and satellite valves having smaller nominal widths than the main valve and being fastened to the housing of the main valve, without a high-pressure pipe being interposed.

Such a steam conduit is known from German Patent DE 27 08 642 C3. That steam conduit is fed through the wall of a containment of a nuclear power station. It extends from a steam generator into the containment. The steam conduit forms a fixed point with the wall in a leadthrough through the wall. A conical supporting body is provided, inter alia, for that purpose. The fixed point serves for introducing forces and moments from the steam conduit into the wall, so that damage to the steam conduit is avoided.

A German patent corresponding to French Patent FR 2 259 420 is cited in German Patent DE 27 08 642 C3. Three fittings shown therein are disposed in a row one behind the other so that passages form a straight pipe. Such a linear configuration can enter into mechanical vibrations, if no supports are provided. A solution to that problem was already mentioned in German Patent DE 27 08 642 C3.

It is known from German Patent DE 27 08 642 C3 for the housing of a main valve to be connected directly to the fixed point outside the wall. The housings of a plurality of other valves are connected directly to that housing. Those other valves may be referred to as satellite valves, since they are disposed on circles around a center point of the main valve. Each satellite valve is connected directly to the main valve, without a pipe piece being interposed. In that case, the nominal width of the satellite valve is smaller than the nominal width of the main valve.

The forces and moments which act on the satellite valves are introduced into the wall at the fixed point through the use of the so-called satellite configuration of valves on the steam conduit. No additional supports are needed.

It has heretofore been customary for additional valves which are required and for which there is no room on the housing of the main valve, to be mounted separately. Specific supports for those additional valves were necessary for that purpose. Furthermore, precautions had to be taken to ensure that conduits required between valves which are supported at the fixed point on one hand, and additional valves on the other hand, could not be damaged by forces and moments which are introduced.

SUMMARY OF THE INVENTION

It is accordingly an object of the invention to provide a steam power station, which overcomes the hereinafore-mentioned disadvantages of the heretofore-known devices of this general type and in which no special supporting devices are necessary even for such additional valves.

With the foregoing and other objects in view there is provided, in accordance with the invention, a steam power station, comprising a wall; a steam conduit leading through the wall and forming a fixed point with the wall for introduction of forces and moments; a main valve having a housing and a given nominal width, the main valve connected to the steam conduit at the fixed point, without a high-pressure pipe interposed; satellite valves having housings and nominal widths smaller than the given nominal width, the satellite valves fastened to the housing of the main valve, without a high-pressure pipe interposed; and at least one additional valve having a housing fastened to the housing of at least one of the satellite valves, without a high-pressure pipe interposed and without any support.

It became clear, surprisingly, that even in the case of a valve configuration in which the known satellite configuration is supplemented by additional valves on the satellite valves in the manner described, forces and moments which take effect can be introduced into the wall without difficulty at the existing fixed point. This affords the advantage of permitting a markedly larger number of valves than heretofore to be held at a fixed point. There is no need for complicated additional vibration-proof supports.

In accordance with another feature of the invention, the housings of a plurality of additional valves form a row and only the housing of the first additional valve in the row is fastened to the housing of a satellite valve. This affords the advantage of permitting even more additional valves than otherwise to be connected to a satellite valve, without a high-pressure pipe being interposed.

In accordance with a further feature of the invention, there is provided at least one supplementary valve which can also be fastened through the use of its housing to the housing of an additional valve, without a high-pressure pipe being interposed and without any support.

In accordance with a concomitant feature of the invention, there is provided a row formed of supplementary valves, this row can be fastened to the housing of an additional valve. In this case, the configuration and fastening are provided in a similar way to the row of additional valves.

The steam conduit according to the invention affords the advantage of allowing all valves connected to such a steam conduit to be held securely in the wall at only one fixed point. Forces and moments acting on the valve group are advantageously introduced into the wall at only one fixed point.

Other features which are considered as characteristic for the invention are set forth in the appended claims.

Although the invention is illustrated and described herein as embodied in a steam power station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
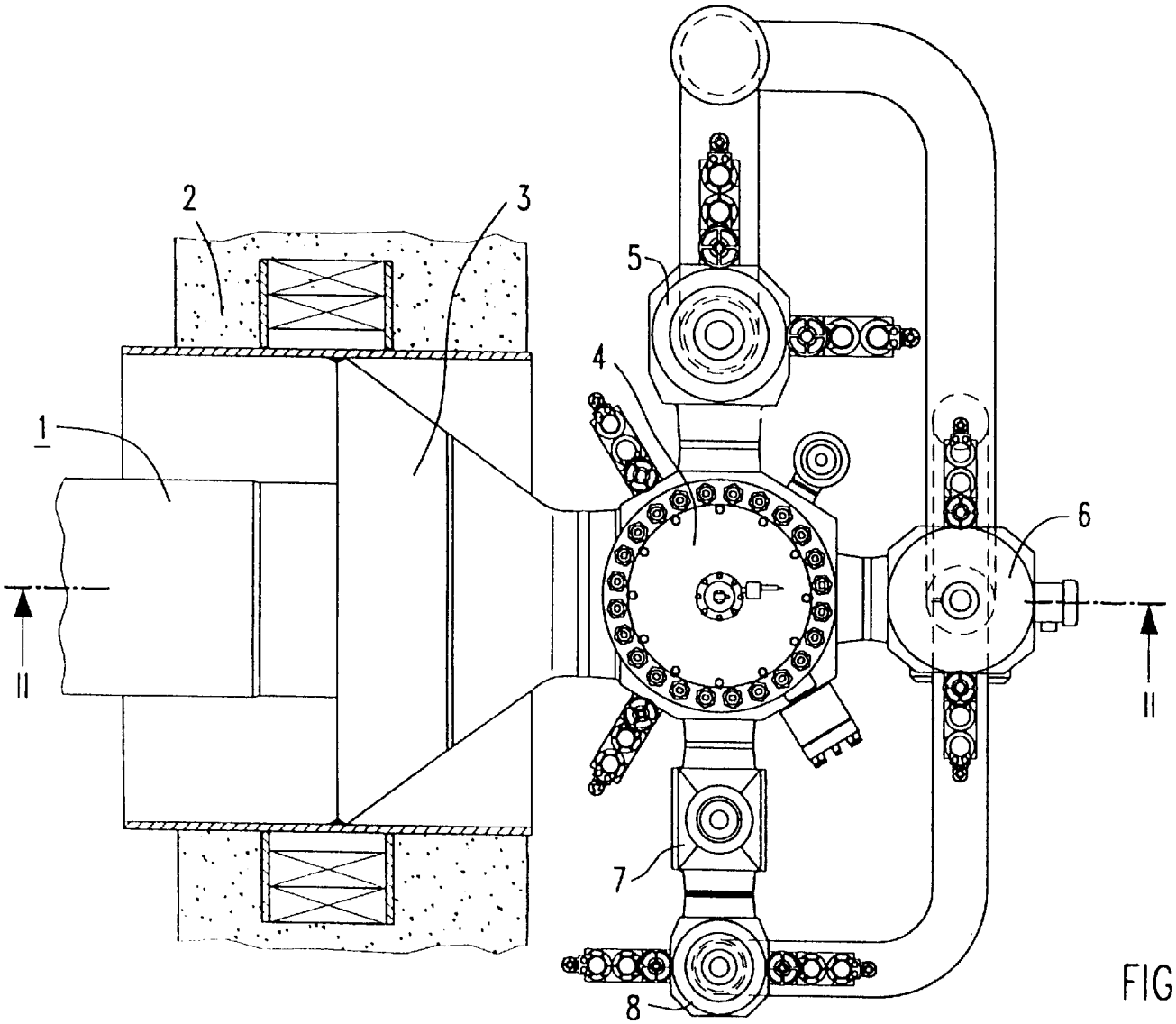
FIG. 1 is a fragmentary, diagrammatic, top-plan view of a configuration according to the invention.
Figure 2:
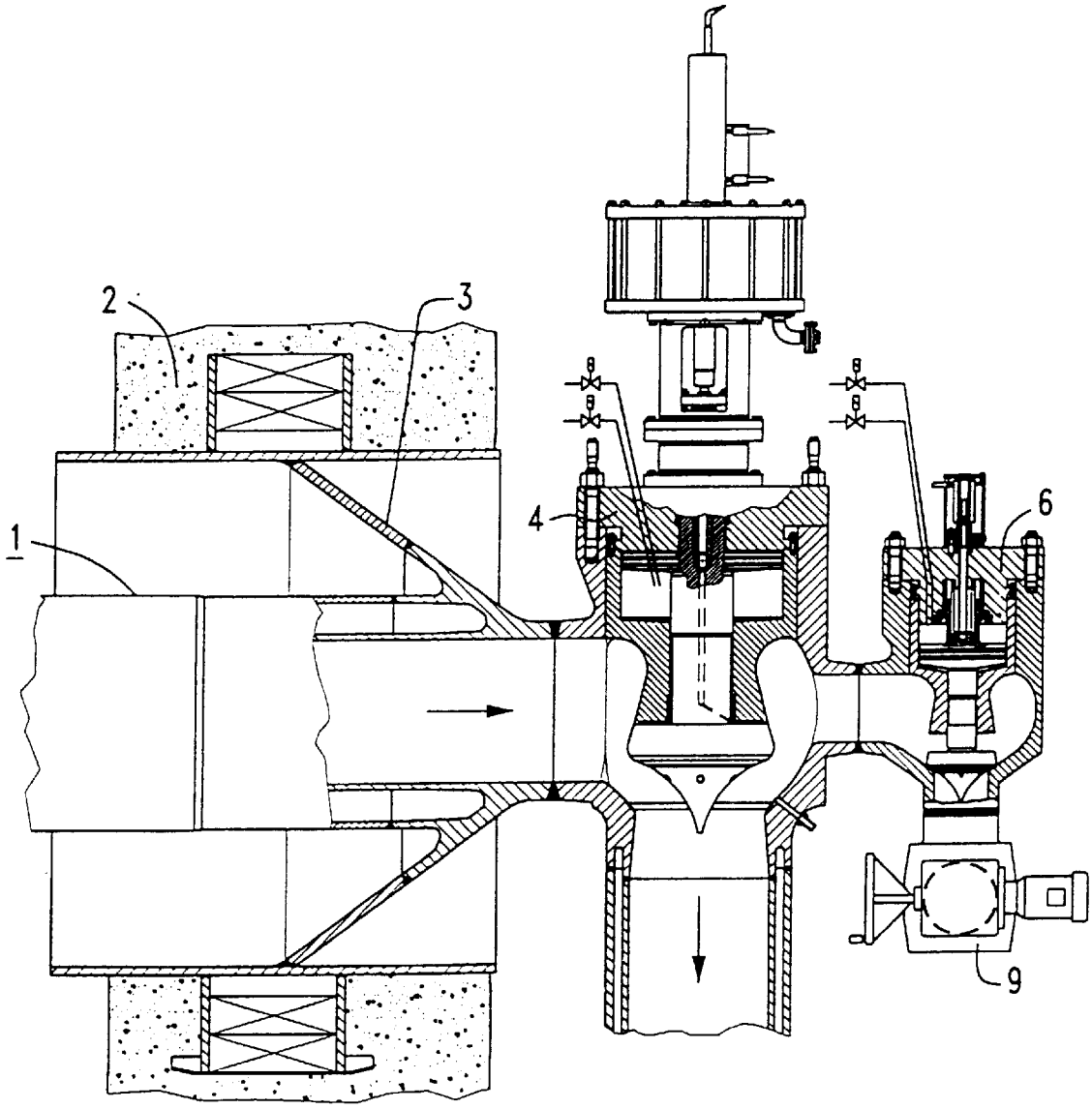
FIG. 2 is a fragmentary, longitudinal-sectional view taken along a line II—II of FIG. 1, in the direction of the arrows.

Referring now in detail to the figures of the drawings as a whole, there is seen a steam conduit 1 which comes from a non-illustrated steam generator and is led through a wall 2 of a containment of a nuclear power station. In order to form a fixed point in a leadthrough through the wall 2, a conical supporting body 3 is provided for supporting the steam conduit 1 in the leadthrough of the wall 2. Forces and moments acting on the steam conduit 1 are introduced into the wall 2 at the fixed point. A housing of a main valve 4 is connected to the steam conduit 1 at the fixed point, directly at the leadthrough, without a high-pressure pipe being interposed. Housings of satellite valves 5 to 7 are likewise connected to the housing of this main valve 4, without a high-pressure pipe being interposed. Center points of the satellite valves 5 to 7 are located on circles around a center point of the main valve 4.

There may no longer be any room on the housing of the main valve 4 for additional valves which are still required. If that is the case, in the steam conduit according to the invention, at least one additional valve 8, 9 is fastened to the housing of a satellite valve 5 to 7, without a high-pressure pipe being interposed and without any support.

A plurality of additional valves can also be aligned with one another to form a row and their housings can be connected to one another. In this case, a housing of a first additional valve of this row is fastened to the housing of the satellite valve 5 to 7, without a high-pressure pipe being interposed. One or more of such rows can be fastened to each satellite valve 5, 6.

It is even possible for at least one supplementary valve and/or one or more rows of supplementary valves, which can be connected to one another in the same way as additional valves to be fastened to the housing of an additional valve 8, 9.

The entire illustrated valve configuration makes it possible for forces and moments acting on it to be introduced into the wall 2 through the fixed point shown.

We claim:

1. A steam power station, comprising:

a wall;

a steam conduit leading through said wall and forming a fixed point with said wall for introduction of forces and moments;

a main valve having a housing and a given nominal width, said main valve connected to said steam conduit at said fixed point, without a high-pressure pipe interposed;

satellite valves having housings and nominal widths smaller than said given nominal width, said satellite valves fastened to said housing of said main valve, without a high-pressure pipe interposed; and at least one additional valve having a housing fastened to said housing of at least one of said satellite valves, without a high-pressure pipe interposed and without any support.

2. The steam power station according to claim 1, wherein said at least one additional valve is a plurality of additional valves having mutually aligned housings forming a row, said additional valves including a first additional valve, and said housing of said first additional valve fastened to said housing of one of said satellite valves, without a high-pressure pipe interposed.

3. The steam power station according to claim 1, including at least one supplementary valve having a housing fastened to said housing of said at least one additional valve, without a high-pressure pipe interposed and without any support.

4. The steam power station according to claim 3, wherein said at least one supplementary valve is a plurality of supplementary valves having mutually aligned housings forming a row, said supplementary valves including a first supplementary valve, and said housing of said first supplementary valve fastened to said housing of said at least one additional valve, without a high-pressure pipe interposed.

5. A nuclear power station, comprising:

a wall;

a steam conduit leading through said wall and forming a fixed point with said wall for introduction of forces and moments;

a main valve having a housing and a given nominal width, said main valve connected to said steam conduit at said fixed point, without a high-pressure pipe interposed;

satellite valves having housings and nominal widths smaller than said given nominal width, said satellite valves fastened to said housing of said main valve, without a high-pressure pipe interposed; and at least one additional valve having a housing fastened to said housing of at least one of said satellite valves, without a high-pressure pipe interposed and without any support.

* * * * *